US008746475B2

(12) United States Patent
Kountotsis

(10) Patent No.: US 8,746,475 B2
(45) Date of Patent: Jun. 10, 2014

(54) MULTI-CHAMBERED BOTTLES FOR SEPARATING CONTENTS AND METHODS OF MANUFACTURING THE SAME

(76) Inventor: Theodosios Kountotsis, East Elmhurst, NY (US)

( * ) Notice: Subject to any disclaimer, the term of this patent is extended or adjusted under 35 U.S.C. 154(b) by 783 days.

(21) Appl. No.: 12/381,805

(22) Filed: Mar. 17, 2009

(65) Prior Publication Data

US 2010/0237034 A1 Sep. 23, 2010

(51) Int. Cl.
*B65D 25/08* (2006.01)
*B65D 25/28* (2006.01)
*B65D 23/10* (2006.01)

(52) U.S. Cl.
USPC ..... 215/6; 215/396; 220/525; 220/529; 220/553; 220/592.17; 220/756

(58) Field of Classification Search
USPC ..... 215/6, 396; 220/524, 503, 5, 532, 220/367.1, 756, 505, 632, 521.525, 529, 220/553, 592.17; 222/142.1, 142.3, 142.7, 222/556, 465.1; 206/217
See application file for complete search history.

(56) References Cited

U.S. PATENT DOCUMENTS 127,976 A * 6/1872 Hoyt ..... 222/144
760,434 A * 5/1904 Donghue ..... 220/524
1,033,689 A * 7/1912 Fuchs ..... 222/142.1
1,035,884 A * 8/1912 Leiner ..... 222/142.1
1,724,028 A * 8/1929 Kraft ..... 222/142.3
1,761,806 A * 6/1930 Tramer ..... 241/163
2,335,016 A * 11/1943 Lorenzen et al. ..... 220/524
2,540,846 A * 2/1951 Thompson ..... 222/142.4
2,612,114 A * 9/1952 Ernst ..... 418/26
2,661,870 A * 12/1953 Huenergardt ..... 222/129
2,712,668 A * 7/1955 Thiele ..... 15/264
2,734,663 A * 2/1956 Lucas ..... 222/142.1
2,748,946 A * 6/1956 Smith ..... 210/244
3,258,369 A * 6/1966 Blaich ..... 429/185
3,349,987 A * 10/1967 Weitzner ..... 229/103.1
3,459,295 A * 8/1969 Cousar ..... 206/219
4,277,000 A * 7/1981 Jaarsma ..... 222/142.4
4,301,942 A * 11/1981 Kupperman et al. .... 220/592.17
4,802,608 A * 2/1989 Hofmann ..... 222/142.1
4,804,113 A * 2/1989 Ciaccio ..... 222/142.1
4,817,808 A * 4/1989 Bracy ..... 220/524
4,867,328 A * 9/1989 McCarthy ..... 220/533
4,955,503 A * 9/1990 Propes ..... 220/526
4,971,211 A 11/1990 Lake
5,332,112 A * 7/1994 Blocker ..... 215/6
5,332,157 A 7/1994 Proctor
5,335,589 A * 8/1994 Yerves et al. ..... 99/295
D361,509 S 8/1995 Dull et al.
5,497,920 A 3/1996 Moeller et al.
5,507,156 A 4/1996 Redmon (Continued)

*Primary Examiner* — Sue A Weaver
(74) *Attorney, Agent, or Firm* — Theodosios Kountotsis

(57) ABSTRACT

A bottle including a body portion having a dividing wall extending from a base portion to a connection region; a first chamber for holding first content; and a second chamber for holding second content; wherein a height of the dividing wall is greater than an overall height of the body portion, wherein the first chamber is configured to cooperate with a first orifice via a first surface and the second chamber is configured to cooperate with a second orifice via a second surface; and wherein one end of the first surface and one end of the second surface are configured to be adjacent to the connection region of the dividing wall to separate the first content from the second content.

16 Claims, 11 Drawing Sheets

(56) References Cited

U.S. PATENT DOCUMENTS

| | | | | |
|---|---|---|---|---|
| 5,597,087 | A | 1/1997 | Vinarsky | |
| 5,667,101 | A | 9/1997 | Barrash et al. | |
| 5,881,918 | A * | 3/1999 | Eichler | 222/135 |
| 6,010,034 | A | 1/2000 | Walthers | |
| 6,120,202 | A | 9/2000 | Donsky | |
| 6,135,323 | A | 10/2000 | Chen et al. | |
| 6,276,163 | B1 * | 8/2001 | Broadbent | 62/457.4 |
| 6,499,614 | B1 * | 12/2002 | Thompson | 215/6 |
| 6,550,647 | B1 | 4/2003 | Kunz | |
| 6,758,411 | B2 | 7/2004 | Conway et al. | |
| D497,104 | S | 10/2004 | Best et al. | |
| D507,738 | S | 7/2005 | Wagner | |
| D510,529 | S | 10/2005 | Yates, III | |
| 7,036,684 | B1 | 5/2006 | Hantman et al. | |
| 7,331,478 | B2 | 2/2008 | Aljadi | |
| 7,784,635 | B2 * | 8/2010 | Luburic | 220/505 |
| 2004/0159625 | A1 | 8/2004 | Kwon | |
| 2005/0109796 | A1 | 5/2005 | Bourque et al. | |
| 2005/0184090 | A1 | 8/2005 | DeJonge | |
| 2006/0021996 | A1 | 2/2006 | Scott, III et al. | |
| 2006/0043047 | A1 * | 3/2006 | Johnson | 215/6 |
| 2006/0102581 | A1 | 5/2006 | Yates, III | |
| 2007/0267416 | A1 * | 11/2007 | Eichenbaum | 220/524 |
| 2008/0000866 | A1 | 1/2008 | Yates, III | |
| 2008/0121654 | A1 | 5/2008 | Pilowski | |
| 2008/0128378 | A1 | 6/2008 | Nowzari | |
| 2009/0294397 | A1 * | 12/2009 | Wu | 215/6 |

* cited by examiner

MULTI-CHAMBERED BOTTLES FOR SEPARATING CONTENTS AND METHODS OF MANUFACTURING THE SAME

BACKGROUND

1. Field of the Related Art

The present disclosure relates to bottles, and more particularly, but not exclusively, to bottles having a plurality of chambers that are configured to cooperate with each other to form a single bottle for the separate storage and dispensement of contents.

2. Description of the Related Art

Liquid storage containers have been provided in numerous shapes and sizes for various liquid commodities. The most ubiquitous liquid storage containers are presently plastic and provide multiple shapes and sizes with mass production capability and recyclable materials. A popular liquid storage container is a drinking bottle. Typically, most individuals utilize a drinking bottle formed of a molded plastic material. The most common type of molded plastic drinking bottle employs a neck portion supporting a removable cap and a chamber connected to the neck portion. These plastic drinking bottles are reasonably durable, are reusable with most liquid drinks of choice, are economical to make and to purchase, and are easy to use (in that an individual can grip the bottle with one hand and take a drink via the outlet means without spilling the liquid).

In particular, sports bottles have become very popular over the years as molded plastic drinking bottles. Sports bottles are containers which generally have a removable lid, are relatively tall and easy to hold and have a cap or lid positioned at the top portion of the sports bottle. Sports bottles have become quite popular given the increased exercise activity of individuals. Sports bottles are convenient because they do not leak and can be readily carried or placed without fear of spilling the liquid contained therein. To use a sports bottle, one simply places the desired liquid in the sport bottle and closes the lid and/or inserts a straw. Thereafter, whenever it is desired to acquire liquid, one merely opens the lid to allow access to the liquid.

Many individuals who exercise are interested in workouts of extended durations, at various levels of intensity. Thus, many individuals have available or even carry several individual bottles of water or other liquids to replenish body liquids lost from sweating. These individuals may particularly seek to take more than one type of drink while maintaining the same exercise pace and without carrying multiple bottles containing different liquids. Thus, many individuals may desire more than one type of drink to replenish body liquids lost from sweating when engaging in one or more intense workout activities, without inadvertently mixing the liquids.

Furthermore, one of the most critical needs facing individuals engaged in sports is the continuous supply or intake of different liquids (e.g., water, sports drinks, energy drinks, protein shakes, etc.) while they exercise. During extended exercise activities, individuals face serious dehydration problems and the loss of competitive capability unless they continuously replenish the fluids lost during such exercise activities. However, the human body requires many different types of vitamins or minerals that cannot all be found in one type of liquid. As a result, once again, individuals may desire more than one type of drink to replenish body liquids lost from sweating when engaging in one or more intense workout activities, without inadvertently mixing the liquids, in order to replenish several types of vitamins and minerals.

Moreover, sports enthusiasts are typically becoming more aware of the benefits of combining the use of electrolyte replacing sports drinks and/or water and/or protein shakes for ultimate performance enhancement and refreshment. Additionally, even children/teenagers often desire to consume more than a single flavor of soft drink or juices or any other type of desirable liquid. Also, adults who consume caffeinated energy drinks frequently purchase bottled water to compliment the energy drink in order to quench their thirst. In other words, such individuals must carry two or more bottles to quench their thirst. Thus, there is a need to provide a bottle that is capable of dispensing more than one type of liquid separately, without inadvertently mixing the liquids.

Consequently, traditional sports bottles present a limitation in that they do not allow an individual to enjoy a plurality of different liquid drinks separately from each other, without mixing the liquids, and at the same time period. Presently, many dual chamber bottle systems lack the ability to effectively provide two or more liquids to an individual without mixing the liquid contents. In addition, another limitation is the fact that an individual must carry a plurality of bottles, each of the plurality of bottles containing different liquids. Moreover, many individuals have a desire to combine the intake of liquids with the intake of solid supplements, such as energy bars, energy gels, vitamin/mineral supplements, etc.

Traditional dual chamber bottles do not provide for effective means of purposely separating two or more liquids or a liquid and a non-liquid desired to be consumed by an individual. In other words, traditional dual chamber bottles allow for inadvertent mixing of liquids, even though the individual desires to consume only one drink at a time. Thus, despite other practitioners' efforts to provide improved systems, there remains nonetheless a continuing need in the art for an improved liquid supply apparatus for use by individuals, such as, but not limited to, individuals engaged in sports or exercise activities.

The present disclosure is intended to overcome the drawbacks of conventional dual chamber bottle systems by exploiting bottle morphology in order to successfully separate liquids without allowing inadvertent mixing of liquids.

SUMMARY

The present disclosure provides a bottle including a body portion having a dividing wall extending from a base portion to a connection region; a first chamber for holding first content; and a second chamber for holding second content; wherein a height of the dividing wall is greater than an overall height of the body portion.

The present disclosure also provides a method for manufacturing a bottle, the method comprising the steps of forming a body portion having a dividing wall extending from a base portion to a connection region; forming a first chamber for holding first content; and forming a second chamber for holding second content; wherein a height of the dividing wall is greater than an overall height of the body portion.

The present disclosure also provides a bottle including a first chamber for holding first content, the first chamber having a first orifice and a first connecting member; a second chamber for holding second content, the second chamber having a second orifice and a second connecting member; wherein the first chamber is configured to be secured to the second chamber to selectively permit access to the first content or the second content.

The present disclosure also provides a method for manufacturing a bottle, the method comprising the steps of forming a plurality of chambers, each of the plurality of chambers configured for holding content; and forming one or more connectors, each of the one or more connectors configured to secure the plurality of chambers to each other; wherein the plurality of chambers are configured to selectively permit access to the content of each of the plurality of chambers.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the invention will become apparent to those skilled in the art from this detailed description.

BRIEF DESCRIPTION OF THE DRAWINGS

Various embodiments of the present disclosure will be described herein below with reference to the figures wherein.

Figure 1:
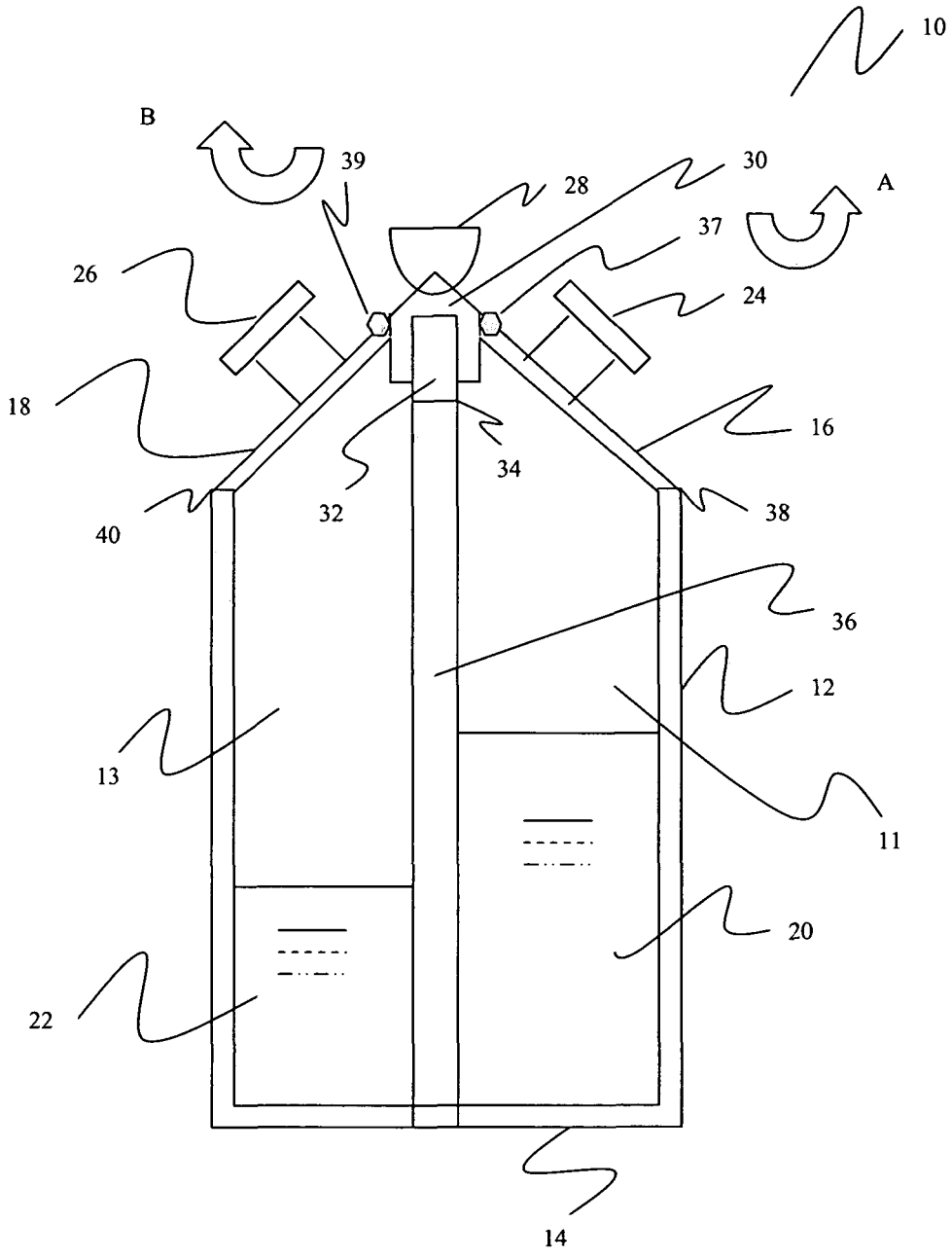
FIG. 1 is a perspective view of a first embodiment of a dual-chambered drinking bottle having two separate chambers and two separate orifices, where the two orifices are connected to two separate units, in accordance with the present disclosure.

It is noted that the drawings of the present disclosure are not to scale. The drawings are intended to depict only typical embodiments of the present disclosure, and therefore should not be considered as limiting the scope of the present disclosure. In the drawings, like numbering represents like elements between the drawings.

DETAILED DESCRIPTION

To provide a comprehensive disclosure without unduly lengthening this specification, applicant incorporates by reference the disclosure of applications with Ser. Nos. 12/291,617, 12/291,616, 12/291,610, and 12/315,790. The first three applications were filed on Nov. 12, 2008 and the fourth application was filed on Dec. 5, 2008. Such applications are co-owned by the same inventor of the present application.

For the purposes of promoting an understanding of the principles of the present disclosure, reference will now be made to the exemplary embodiments illustrated in the drawings, and specific language will be used to describe the same. It will nevertheless be understood that no limitation of the scope of the present disclosure is thereby intended. Any alterations and further modifications of the inventive features illustrated herein, and any additional applications of the principles of the present disclosure as illustrated herein, which would occur to one skilled in the relevant art and having possession of this disclosure, are to be considered within the scope of the present disclosure.

Reference throughout this specification to "one embodiment," "an embodiment," or similar language means that a particular feature, structure, or characteristic described in connection with the embodiment is included in at least one embodiment of the present disclosure. Thus, appearances of the phrases "one embodiment," "an embodiment," and similar language throughout this specification may, but do not necessarily, all refer to the same embodiment, different embodiments, or component parts of the same or different illustrated invention.

Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Moreover, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is, are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Prior to describing the present disclosure in further detail, it will first be helpful to define various terms that will be used throughout the following discussion. For example:

Unless otherwise indicated, all numbers expressing quantities and conditions, and so forth used in the specification and claims are to be understood as being modified in all instances by the term "about." In this application, the use of the singular includes the plural unless specifically stated otherwise. In this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise. The term "coupled to" means to be attached or connect to directly or indirectly or to be incorporated within.

As used in this description and in the appended claims, the word "container" does not necessarily refer to a rigid or a somewhat deformable structure, such as a "bottle," "bottle portion," or "bottle half" for containing liquid. Rather, the word "container" in the present disclosure and in the appended claims can also mean a "box," "packet," "bag," "portion of a bag," "pocket of a bag," or any such deformable structure for containing liquid.

The term "container" may refer to a receptacle. The receptacle may be a container for disposal or storage. The term "container" may also include a bag, bin, bottle, bowl, box, can, canister, canteen, capsule, carton, casket, chamber, crate, flask, jar, jug, packet, package, pouch, receptacle, repository, sack, tank, tub, vase, vessel and/or vial. The "container" may be flexible or non-flexible (rigid) or semi-rigid. The "container" may be transparent, semi-transparent or non-transparent. The "container" may include any number of different substances (liquid or non-liquid or powder) or products or data or information.

As used in the present disclosure and in the appended claims, the word "channel" does not necessarily refer to a tunnel, straw, tube, bore, or other such elongated structure for conveying liquid. Rather, the word "channel" in this description and in the appended claims can also refer to an "opening," or any such structure for conveying liquid. As used in the present disclosure and in the appended claims, the word "chamber" can refer to a cup having an open mouth for drinking or can refer to an enclosed compartment having an opening or orifice for drinking.

The term "fasten" or "fastening" may refer to adhere, affix, anchor, attach, band, bind, bolt, bond, brace, button, cohere, connect, couple, embed, establish, fix, grip, hold, hook, implant, link, lock, lodge, screw, seal, rivet, tack on, tighten, or unite. The term "fasten" or "fastening" may refer to linking/connecting/attaching/locking any type of materials in a removable/detachable/interchangeable manner. The term "fasten" may be equivalent to the term "in cooperation with."

It is desirable to provide a container having multiple elements for storage of different commodities and a means for selecting between them during consumption. It is further desirable that such a container be easily manufactured, filled, and assembled. In particular, the present disclosure relates to a bottle for separately providing two or more liquids to an individual, without mixing the liquids. The present disclosure further relates to a method of manufacturing a multi-chambered bottle that prevents the inadvertent mixture of liquids. The present disclosure further relates to separate chambered components that can be assembled/put together/combined/locked/lodged as a puzzle, in an attachable/detachable manner to form a single bottle, where each separate chamber includes, for example, a liquid.

The present disclosure proposes to provide an improved drinking means or bottle. It is a more particular object of the present disclosure to provide an improved sports bottle which is quickly and easily refillable with two different liquids. It is a still more particular object of the present disclosure to provide an improved sports bottle which is quickly and easily refillable and which effectively prevents the mixture of liquids when dispensed from the bottle by a user. It is a still more particular object of the present disclosure to provide bottle components/elements that can each contain a liquid and be combined to form a single bottle with or without external connecting components/units.

The present disclosure proposes to provide dual compartment pouches/chambers/channels suitable for selectively dispensing two different fluids (e.g., different beverages) from the same container. Such selective dispensing requires a chamber design that allows for manipulation of the compartments individually. This allows the consumer to selectively dispense and consume fluids separately, without the possibility of inadvertently mixing the liquids. The present disclosure also proposes a method for manufacturing a bottle having dual chambers that prevents the inadvertent mixing of liquids. The present disclosure also proposes a method for manufacturing a bottle where components (e.g., chambers/connectors) are manufactured separately and then assembled into one unit.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1, there is presented a perspective view of a first embodiment of a dual-chambered drinking bottle having two separate chambers and two separate orifices, where the two orifices are connected to two separate units, in accordance with the present disclosure.

In the first embodiment, the dual chamber bottle 10 includes a body portion 12, a base portion 14, a first top surface 16, a second top surface 18, a first liquid 20, a second liquid 22, a first orifice 24, a second orifice 26, a handle 28, a first connector 30, a second connector 32, a dividing point 34, a dividing wall 36, a first end 38 of the first top surface 16, a first end 40 of the second top surface 18, a first chamber 11, a second chamber 13, a second end 37 of the first top surface 16, and a second end 39 of the second top surface 18.

Dual chamber bottle 10 includes a body portion 12 that is preferably formed of a hollow molded plastic material that defines two substantially cylindrical liquid chambers 11, 13 and has a base portion 14. The bottle 10 includes a first chamber 11 for holding a first liquid 20 and a second chamber 13 for holding a second liquid 22, where the first liquid 20 is preferably different than the second liquid 22. It will be apparent to those skilled in the art that the diameters and/or heights and/or geometric shapes of the first chamber 11 and the second chamber 13 and/or the body 12 may be selected in accordance with design preferences.

The dividing wall 36 extends vertically from the base portion 14, extending through the body portion 12 and ending at the first connector 30. The dividing wall 36 provides a means for separating the first chamber 11 from the second chamber 13. Applying pressure to one side of the body portion 12 allows the first liquid 20 of the first chamber 11 to be forced out of the compartment/chamber/channel and into the mouth of a user through the first orifice 24. The dividing wall 36 prevents the pressure exerted on the first chamber 11 to be transferred to the second chamber 13, thus allowing the user to selectively dispense the contents/liquids of each individual chamber/container/compartment into the mouth of a user via a channel (e.g., first orifice 24, second orifice 26).

At the top portion of the dividing wall 36 there are two connecting members. That is, first connector 30 and second connector 32. The dividing wall 36 may extend up to dividing point 34. The dividing wall 36 may be securedly fixed to the first connector 30 and second connector 32 via any connecting means envisioned by one skilled in the art. In the exemplary embodiment, the first connector 30 is a U-shaped connector that embeds/encompasses/encloses/envelops/embraces/incorporates the second connector 32 (either partially or in whole). However, it is contemplated that the second connector 32 may be optional. In other words, the dividing wall 36 may extend all the way to the first connector 30. Of course, the first connector 30 may be constructed into any desirable geometric shape in order to engage the dividing wall 36 to the first connector 30.

In operation, the user of the dual chamber bottle 10 can conveniently draw a liquid from the bottle 10 through either the first orifice 24 or the second orifice 26 while maintaining effective separation of the liquids 20 and 22. In operation, the first orifice 24 would be placed in the mouth of a user, who would squeeze the bottle 10 to eject the first liquid 20 from the first chamber 11. Alternately, the second orifice 26 would be placed in the mouth of a user, who would squeeze the bottle 10 to eject the second liquid 22 from the second chamber 13.

In operation, the first chamber 11 is configured to cooperate with the first orifice 24 via the first top surface 16 and the second chamber 13 is configured to cooperate with the second orifice 26 via the second top surface 18. In addition, one end of the first top surface 37 and one end of the second top surface 39 are configured to be adjacent to the connection region (connector 30) of the dividing wall 36 to separate the first liquid 20 from the second liquid 22.

Optionally, the first top surface 16 and the second top surface 18 may be oblique surfaces. The top surfaces 16, 18 may be at a 45 degree angle with respect to the base portion 14. However, it is envisioned that the top surfaces 16, 18 may be any type of surfaces (e.g., contoured surfaces) at any desirable inclination/degree/level with respect to the base portion 14.

Optionally, the first top surface 16 may include a first end 38 and a second end 37, where the second end 37 if fixedly secured to the first connector 30 and the second top surface 18 may include a first end 40 and a second end 39, where the second end 39 if fixedly secured to the first connector 30. This type of configuration would allow the first top surface 16 (having the first orifice 24) and the second top surface 18 (having the second orifice 26) to be opened and closed as shown with respect to arrows "A" and "B." In other words, the top surfaces 16, 18 may be removable or detachable or interchangeable surfaces or they may be surfaces fixed at one end to allow/permit the top surfaces 16, 18 to flip open. In addition, the orifices, 24, 26 may be fixed orifices or removable orifices. A user may wish to remove/detach/change/interchange the orifices as desired (e.g., to insert a different type of orifice or a different color orifice). In other words, the first top surface 16 and the second top surface 18 are separate detachable surfaces attachable to the body portion 12 via any type of fastening means.

Optionally, the dividing wall 36 may be removable. In other words, a user may wish to first remove the top surfaces 16, 18 and then remove the connectors 30, 32, and then be able to remove the dividing wall 36 in order to clean the interior of the body portion 12. The dividing wall 36 may be constructed from any type of material and may be of a different material than the body portion 12 and/or the top surfaces 16, 18. The dividing wall 36 may be designed in any type of shape envisioned by one skilled in the art.

Optionally, the handle 28 may provide for a permanent connection with the first connector 30. In some applications, by providing a separate lid strap for each top surface 16, 18 portion, allows a user to access one chamber while keeping the other chamber inaccessible. In other words, each orifice 24, 26 may be associated with a lid strap in addition to having a handle 28 for the entire bottle 10.

Optionally, the orifices 24, 26 may be coupled to the top surfaces 16, 18 by using any suitable fastening mechanism, such as a threaded fastening mechanism or a snap-fit fastening mechanism or flip-fit mechanism or the like.

Optionally, the chambers 11, 13 can each be of a same or a different volumetric size. In other words, the first chamber 11 may be smaller than the second chamber 13 (or vice versa). In addition, the first orifice 24 may be a different design than the second orifice 26. For example, the first orifice 24 may be a straw configuration, whereas the second orifice 26 may be a cap configuration. Of course, one skilled in the art can contemplate any combination of different types of orifices that are reasonable and/or suitable to such bottle 10. The volumetric size of each chamber 11, 13 may be determined by one or more desired applications. Furthermore, the height of the first chamber 11 and the second chamber 13 can be of a different size. In other words, the height of the first chamber 11 may be greater than the height of the second chamber 13 (or vice versa) depending on the desired application.

It will be apparent to those skilled in the art that this separation of liquids 20, 22 via the dividing wall 36 extending beyond the top of the body portion 12 offers a substantial advantage by providing the capability to drink more than one liquid without inadvertently mixing the liquids 20, 22 and keeping the chambers 11, 13 separate. In other words, a height of the dividing wall 36 is greater than an overall height of the body portion 12 in order to provide effective separation of liquids 20, 22.

Figure 2:
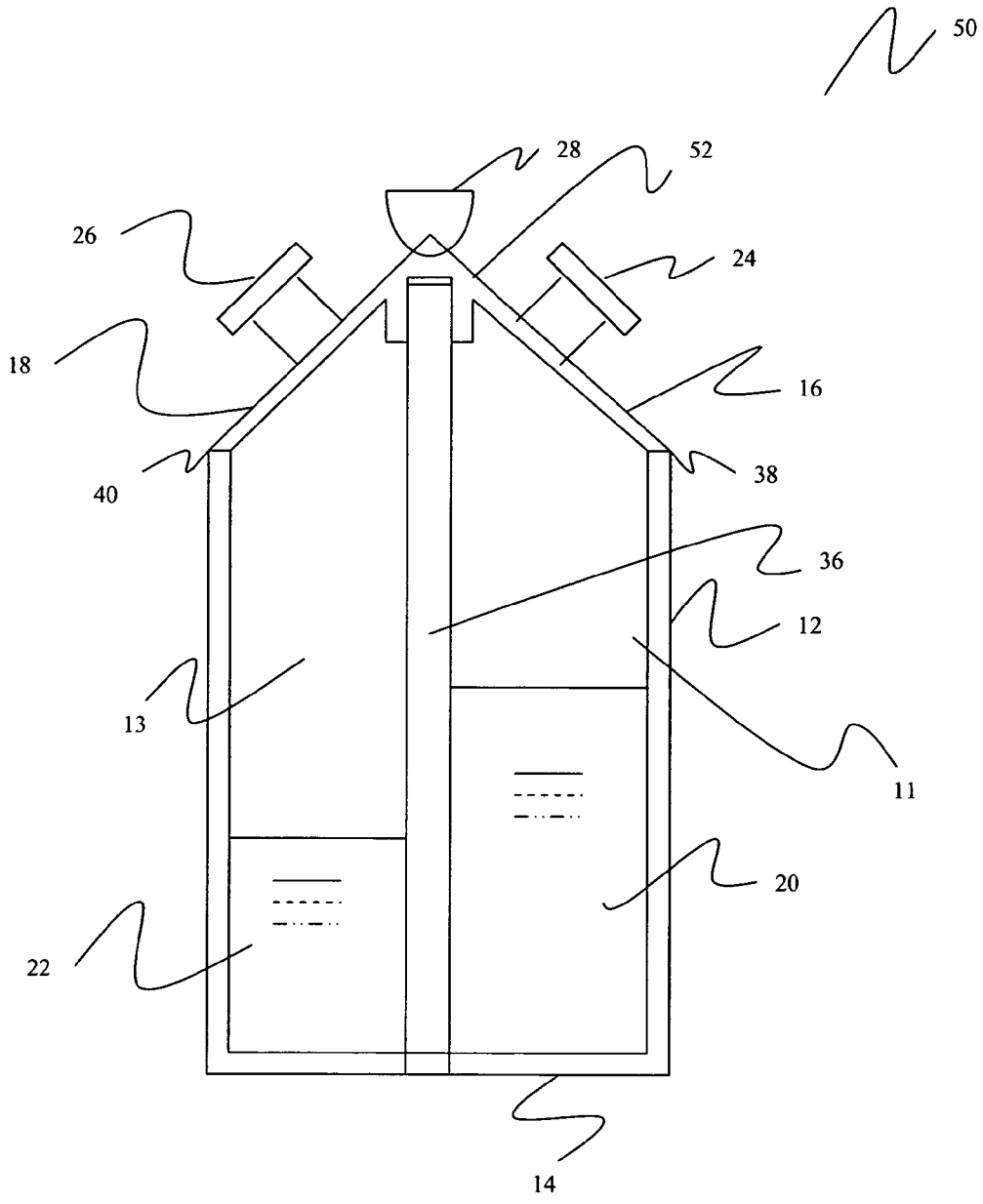
FIG. 2 is a perspective view of a second embodiment of a dual-chambered drinking bottle having two separate chambers, where the two orifices are connected to a common unit, in accordance with the present disclosure.

With reference to FIG. 2, there is presented a perspective view of a second embodiment of a dual-chambered drinking bottle having two separate chambers, where the two orifices are connected to a common unit, in accordance with the present disclosure.

The dual chamber bottle 50 includes a connecting member 52. Additionally, the dual chamber bottle 50 includes similar elements to FIG. 1. These similar elements include elements 12, 14, 16, 18, 20, 22, 24, 26, 28, 36, 38, 40, 11, and 13.

In FIG. 1, the top surfaces 16, 18 were separate surfaces linked together by a connector 30. In other words, the first top surface 16 and the second top surface 18 are separate units that attach to a connector configuration to be operational/functional. In contrast, in FIG. 2, it is contemplated that the first surface and the second surface (of FIG. 1) are configured to define a single unit attachable to the body portion 12. Thus, there may be a single connecting member 52 that includes both the first orifice 24 and the second orifice 26 and extends from the first end 38 of the first top surface to the first end 40 of the second top surface.

The connecting member 52 may be a fixed or a removable/detachable/interchangeable unit. The connecting member 52 is configured to be in cooperation with the dividing wall 36. A portion of the dividing wall 36 may be embedded/encompassed/enclosed/enveloped/embraced/incorporated within a portion of the connecting member 52, as shown in FIG. 2. However, it is contemplated that the dividing wall 36 is not enclosed within a portion of the connecting member 52. It is contemplated that the dividing wall 36 and connecting member 52 be a single non-detachable unit (uniform and continuous unit). The connecting member 52 may be constructed from any type of material and may be constructed in any type of geometric shape to include one or more orifices and to be securedly attached/fixed/engaged to the dividing wall 36. Thus, the connecting member 52 may be a uniform, continuous, homogeneous unit/member/stopping mechanism/attaching mechanism. Additionally, the dividing wall 36 may be removable/detachable from the body portion 12 in order to allow for cleaning of the body portion 12.

Figure 3:
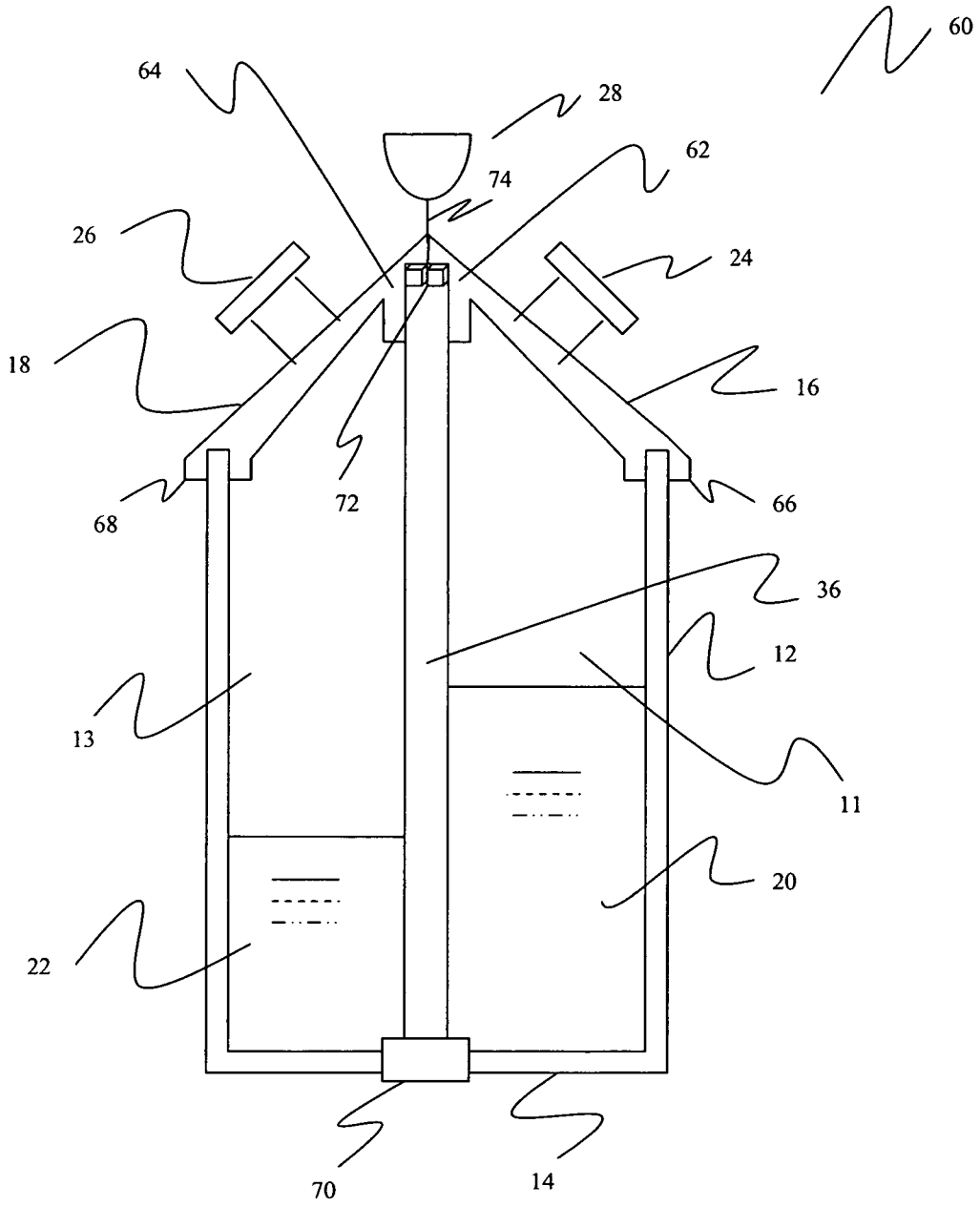
FIG. 3 is a perspective view of a third embodiment of a dual-chambered drinking bottle having two separate chambers and two separate orifices, where the two orifices are detachable units, in accordance with the present disclosure.

With reference to FIG. 3, there is presented a perspective view of a third embodiment of a dual-chambered drinking bottle having two separate chambers and two separate orifices, where the two orifices are detachable units, in accordance with the present disclosure.

The bottle 60 includes a first removable top surface 62, a second top removable surface 64, a first connecting portion 66, a second connecting portion 68, a dividing wall connector 70, a removable top surface connector 72, and a handle connector 74. Additionally, the bottle 60 includes similar elements to FIG. 1. These similar elements include 12, 14, 16, 18, 20, 22, 24, 26, 28, 36, 11, and 13.

The first removable top surface 62 and the second removable top surface 64 may be oblique surfaces. The removable top surfaces 62, 64 may be at a 45 degree angle with respect to the base portion 14. However, it is envisioned that the top surfaces 62, 64 may be any type of surfaces (e.g., contoured surfaces) at any desirable inclination/degree/level with respect to the base portion 14.

The first top surface 62 may include a first connecting portion 66, where the first connecting portion 66 connects to the body portion 12 and the second top surface 64 may include a second connecting portion 68, where the second connecting portion 68 connects to the body portion 12. This type of configuration would allow the first top surface 62 and the second top surface 64 to be removable surfaces. In addition, the orifices, 24, 26 may be fixed orifices or removable orifices. A user may wish to remove/detach/change/interchange the orifices as desired (e.g., to insert a different type of orifice or a different color orifice). In other words, the first top surface 62 and the second top surface 64 are separate detachable surfaces attachable to the body portion 12 via any type of fastening means.

One end of the first top surface 62 and one end of the second top surface 64 may include removable top surface connectors 72 for securedly attaching the first top surface 62 and the second top surface 64 to the dividing wall 36. The top surface connectors 72 may be any type of fastening means for securedly attaching the two components.

For example, the top surface connectors 72 may include one or more sets of a latching projections. These latching projections allow the dividing wall 36 to be fixedly secured to the first top surface 62 and the second top surface 64 of the bottle 60 via orientation recesses located on the first top surface 62 and the second top surface 64. The latching projections may be spaced out as single units or may be spaced out as sets of two, three, or more. Any number of latching projections may be employed to secure the two components. The latching projections and the orientation recesses may be any shape or size contemplated by one skilled in the art.

Optionally, the dividing wall 36 is not removable in this type of configuration. In other words, a dividing wall connector 70 may be positioned so that it engages the body potion 12 to the dividing wall 36 and securedly fixes such components.

Optionally, a handle connector 74 may be connected to the handle 28 for connecting the handle 28 to the bottle 60. Thus, the handle 28 need not be directly linked/locked to the first top surface 62 or the second top surface 64 (or the connector 30 of FIG. 1). The handle 28 can be connected to the bottle configurations (e.g., 10, 50, 60) directly or indirectly via a handle connector 74.

Figure 4:
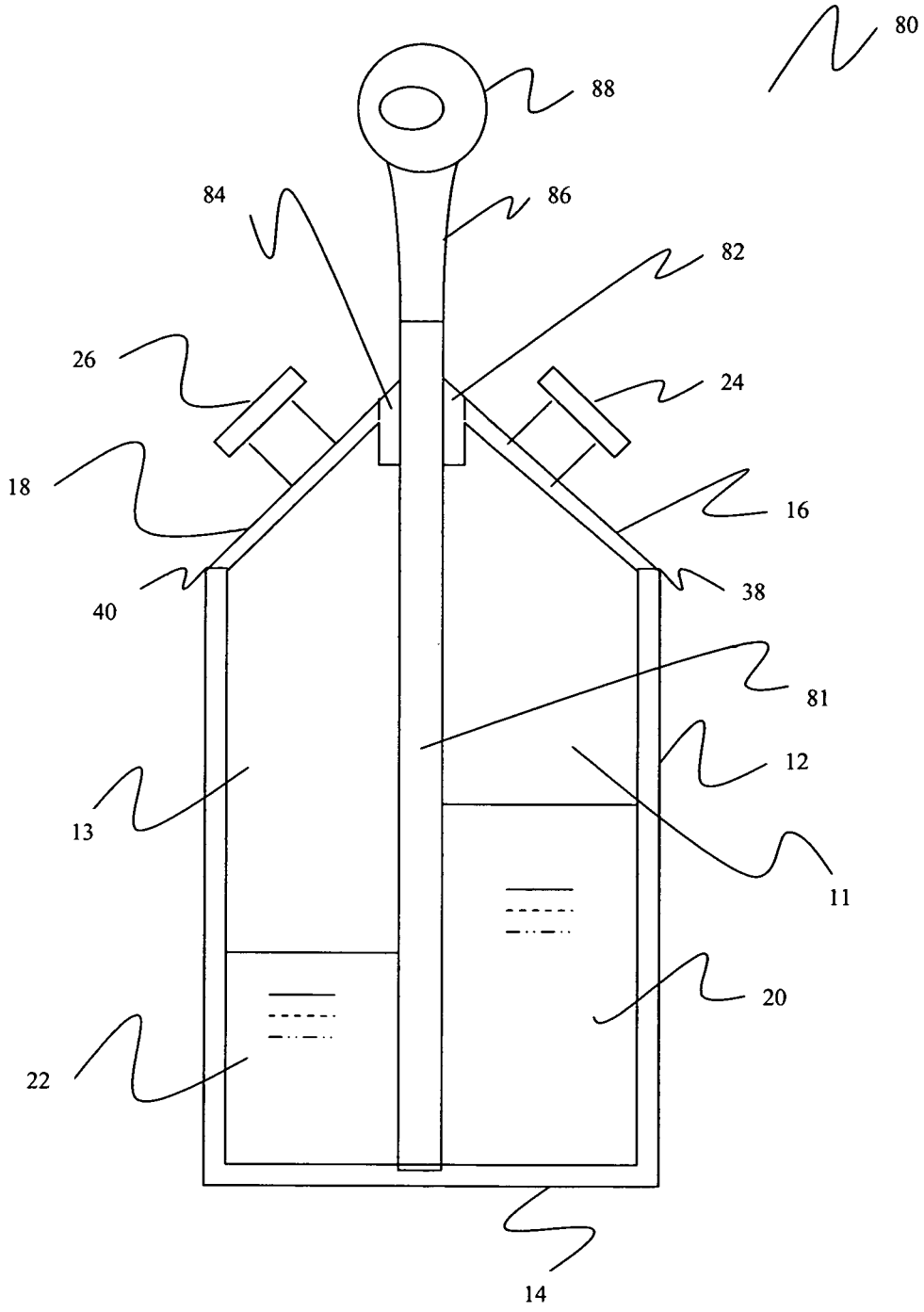
FIG. 4 is a perspective view of a fourth embodiment of a dual-chambered drinking bottle, where the internal dividing wall extends into an external handle, in accordance with the present disclosure.

With reference to FIG. 4, there is presented a perspective view of a fourth embodiment of a dual-chambered drinking bottle, where the internal dividing wall extends into an external handle, in accordance with the present disclosure.

The bottle 80 includes a first upper connector 82, a second upper connector 84, an upper dividing wall portion 86, a handle 88, and a lower dividing wall portion 81. Additionally, the bottle 80 includes similar elements to FIG. 1. These similar elements include 12, 14, 16, 18, 20, 22, 24, 26, 38, 40, 11 and 13.

The bottle 80 includes a dividing wall 36 having a lower dividing wall portion 81 and an upper dividing wall portion 86. The upper dividing wall portion 86 further extends into a handle 88. In other words, the dividing wall 36 extends beyond the overall height of the body portion 12 to include a handle 88 and the dividing wall 36 and the handle 88 define a single unit (uniform and continuous). The handle 88 can be any type of handle size or shape or color or material as contemplated by one skilled in the art. It is contemplated that the upper dividing wall portion 86 is located outside the body portion 12, whereas the lower dividing wall 81 is located within the body portion 12.

Additionally, it is contemplated that the body portion 12, the dividing wall 36, and the handle 88 are one continuous and uniform unit, where only the top surfaces 16, 18 are removable from the bottle configuration. Additionally, the first upper connector 82 and the second upper connector 84 may be incorporated with the top surfaces 16, 18. However, it is contemplated that the first upper connector 82 and the second upper connector 84 may be incorporated with the upper dividing wall portion 86. The first upper connector 82 and the second upper connector 84 may be fastened to the top surfaces 16, 18 and/or the dividing wall 36 by any fastening means.

Figure 5:
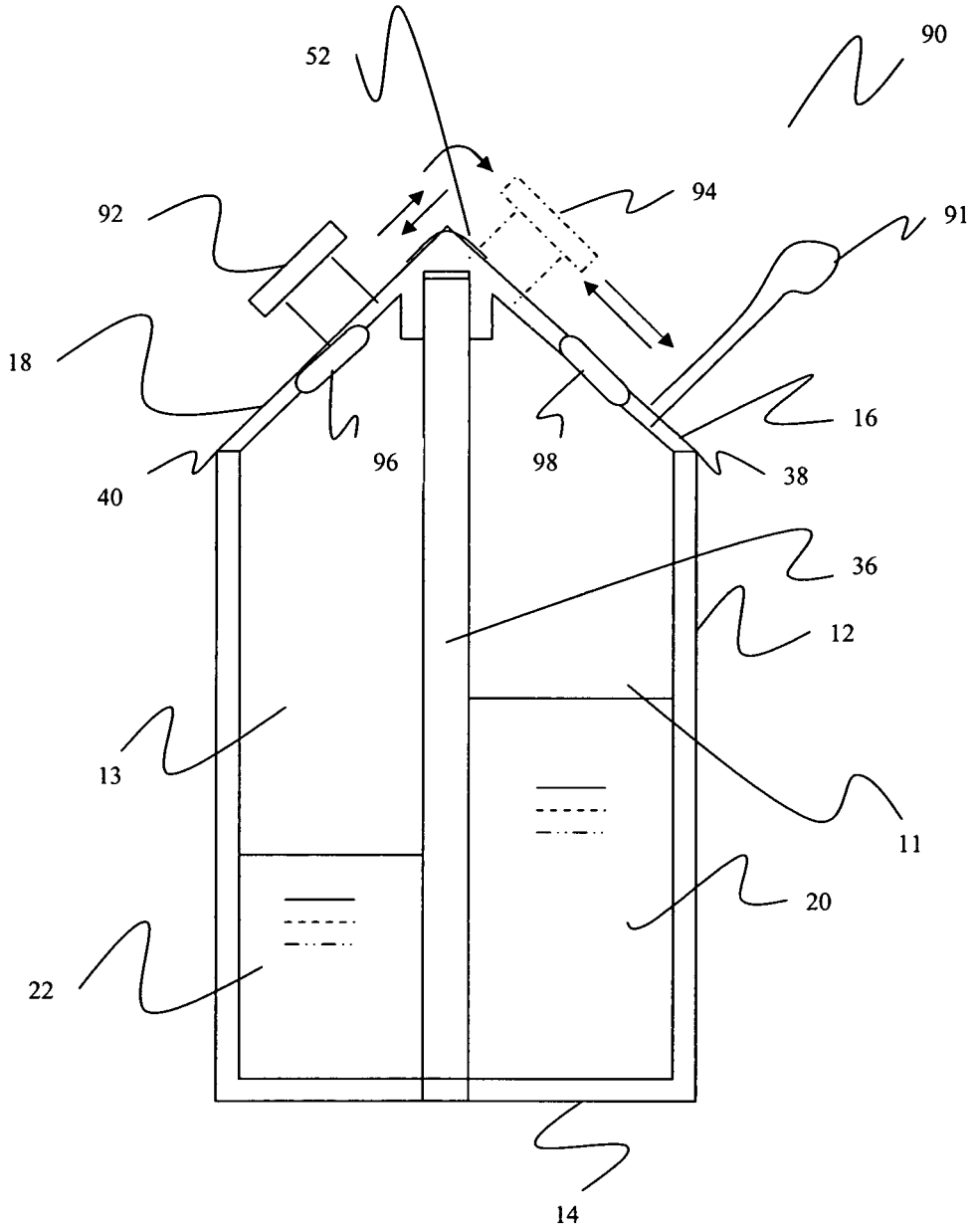
FIG. 5 is a perspective view of a fifth embodiment of a dual-chambered drinking bottle having one slidable orifice between the two chambers, in accordance with the present disclosure.

With reference to FIG. 5, there is presented a perspective view of a fifth embodiment of a dual-chambered drinking bottle having one slidable orifice between the two chambers, in accordance with the present disclosure.

The bottle 90 includes a first position of orifice 92, a second position of orifice 94, a first access point 96, a second access point 98, and a handle 91. Additionally, the bottle 90 includes similar elements to FIG. 1. These similar elements include 12, 14, 16, 18, 20, 22, 36, 38, 40, 52, 11, and 13.

The orifice of bottle 90 is slidably movable across the surface of the connecting member 52. The orifice can slidably move between a first position of the orifice 92 and a second position of the orifice 94. A clicking or snapping mechanism may be engaged to secure the orifice to either the first position 92 or the second position 94. The first position 92 and the second position 94 are fixed points on the top surfaces 16, 18.

In other words, the first position 92 is fixed to a first access point 96 and the second position 94 is fixed to a second access point 98. The first access point 96 and the second access point 98 are fixed position on the top surfaces 16, 18.

The orifice may slidably move between the first position 92 and the second position 94 by means of or via a slidable track (not shown). The slidable track ensures that the orifice moves in a predetermined or pre-designated path along the surface of the connecting member 52. The slidable function allows the user of the bottle 90 to readily switch between the first chamber 11 and the second chamber 13 to selectively access either liquid 20 or liquid 22. The arrows indicate that the orifice can move in a horizontal direction. However, it is contemplated that the path may not be a linear path. The path may be a circular path or a zigzag path or any other type of path that may be contemplated for moving the orifice over the connecting member 52.

Figure 6:
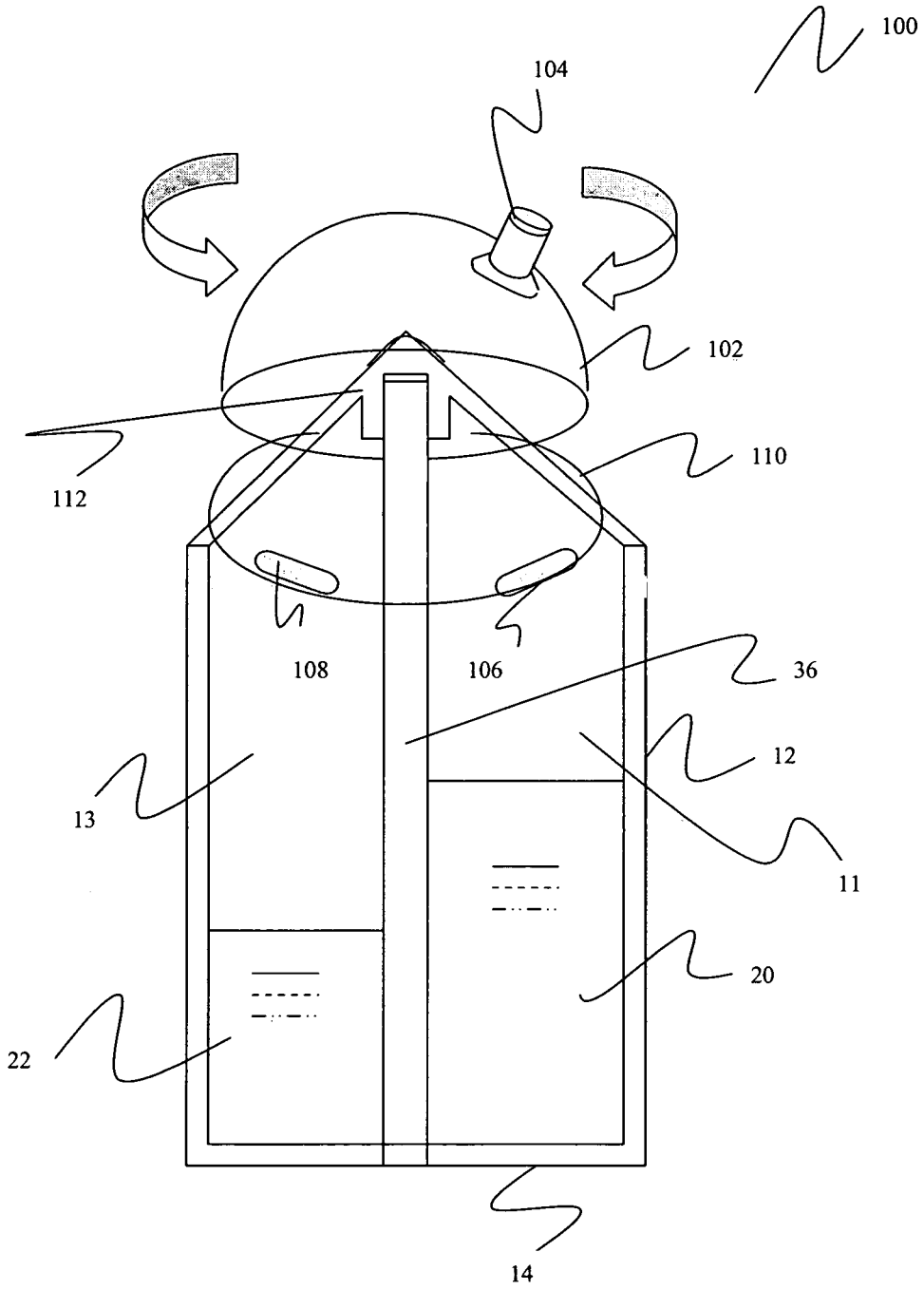
FIG. 6 is a perspective view of a sixth embodiment of a dual-chambered drinking bottle having one rotatable orifice between the two chambers, in accordance with the present disclosure.

With reference to FIG. 6, there is presented a perspective view of a sixth embodiment of a dual-chambered drinking bottle having one rotatable orifice between the two chambers, in accordance with the present disclosure.

The bottle 100 includes a dome cap 102, an orifice 104, a first access point 106, a second access point 108, a top surface of the body 110, and a connecting member 112. Additionally, the bottle 100 includes similar elements to FIG. 1. These similar elements include 12, 14, 20, 22, 36, 11, and 13.

The cap 102 of bottle 100 is molded into a dome shape including a single orifice 104. The dome-shaped cap 102 can be any reasonable and/or suitable size for securedly fitting onto the top surface 110 of the body 12 of the bottle 100. The orifice 104 remains in a fixed position on the dome-shaped cap 102. However, the dome cap 102 can be rotated to shift the orifice 104 between two positions (i.e., first access point 106 and second access point 108) in order to allow individual and separate access to the first bottle opening (via the first access point 106) and the second bottle opening (via the second access point 108). This exemplary configuration, as all other exemplary configurations of the present disclosure, prevents the inadvertent mixture of liquids 20, 22 located in chambers 11, 13, respectively.

The orifice 104 may slidably move between the first access point 106 and the second access point 108 by means of or via a slidable track (not shown). The slidable track ensures that the orifice 104 moves in a predetermined or pre-designated path along the surface of the connecting member 112. The slidable function allows the user of the bottle 100 to readily switch between the first chamber 11 and the second chamber 13 to selectively access either liquid 20 or liquid 22. The arrows indicate that the orifice can move in a horizontal, rotatable direction. The top portion of the connecting member 112 may be engaged to the top portion of the cap 102. The bottom portion of cap 102 may be secured to the bottle 100 via the top surface 110 of body portion 12.

Figure 7:
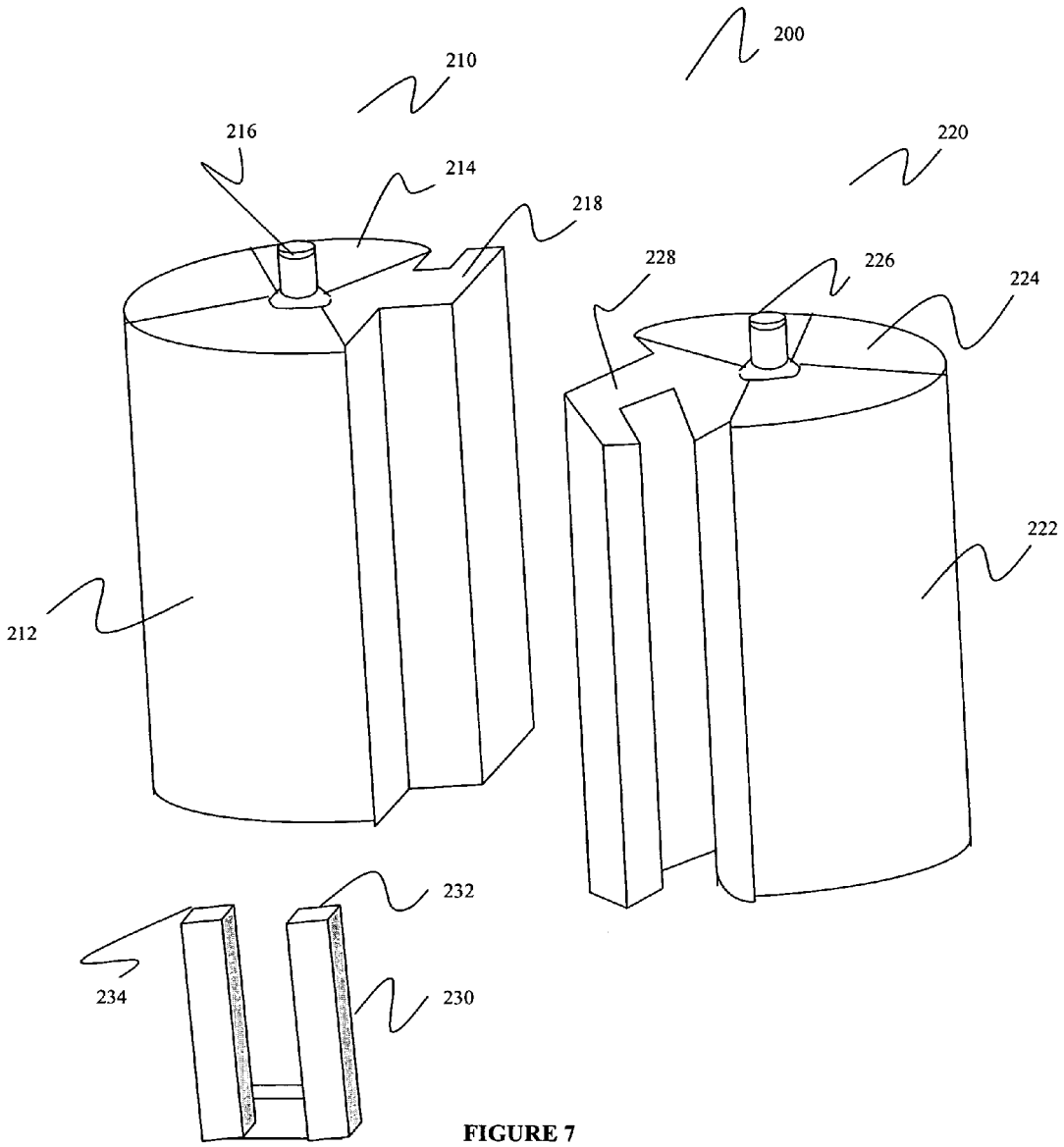
FIG. 7 is a perspective view of a seventh embodiment of a dual-chambered drinking bottle having two separate chambers that are attachable via a U-shaped connector, in accordance with the second embodiment of the present disclosure.

With reference to FIG. 7, there is presented a perspective view of a seventh embodiment of a dual-chambered drinking bottle having two separate chambers that are attachable via a U-shaped connector, in accordance with the second embodiment of the present disclosure.

The first bottle configuration 200 includes a first chamber 210, a first content portion 212, a top surface of first chamber 214, a first orifice 216, a first connector 218, a second chamber 220, a second content portion 222, a top surface of second chamber 224, a second orifice 226, a second connector 228, a third connector 230, a first top of third connector 232, and a second top of third connector 234.

The first chamber 210 includes a first content portion 212, a first orifice 216, and a first connector 218. The second chamber 220 includes a second content portion 222, a second orifice 226, and a second connector 228. The first connector 218 and the second connector 228 may extend the entire length of the first chamber 210 and the second chamber 220, respectively. However, it is contemplated that the first connector 218 and the second connector 228 may extend a length shorter than the entire length of the first chamber 210 and the second chamber 220, respectively. In other words, the first connector 218 and the second connector 228 may be molded onto any portion or portions of the first chamber 210 and second chamber 220, respectively. The first connector 218 and the second connector 228 may be positioned on the top portions, the bottom portions, the side portions or any combination thereof of the first chamber 210 and the second chamber 220, respectively. In addition, there could be a plurality of connecting portions/connectors on each chamber 210, 220. The connectors 218, 228 may be any shape, any size, any design, any material, and/or any color envisioned by one skilled in the art. Of course any number and any design of orifices may be positioned on top surfaces 214, 224 of the chambers 210, 220.

The first connector 218 and the second connector 228, in this exemplary embodiment, require a third connector 230 to be assembled (as shown below with reference to FIG. 8A). The third connector 230 includes a first top 232 and a second top 234. The third connector 230 may be configured in any type of design (e.g., a U-shaped design) in order to provide effective engagement between the first chamber 210 and the second chamber 220. However, more than one connector can be used to securedly engage the first chamber 210 to the second chamber 220. In other words, a plurality of different connectors (size, shape, colors) can be configured/constructed to permit/allow the secured connection between the first chamber 210 and the second chamber 220.

Optionally, the first connector 218 and the second connector 228 may include liquid from the first chamber and second chamber, respectively. However, it is contemplated that the first chamber 210 and the second chamber 220, are separate from the first connector 218 and the second connector 228, respectively. In other words, if a user fills the first chamber 210 with a liquid, the liquid may be confined only in the first content portion 214 or may be permitted to flow in both the first content portion 214 and the first connector 218.

In operation, a user may fill the first chamber 210 with a first liquid and the second chamber 220 with a second liquid. Once the two chambers 210, 220 are filled, they can be connected to each other via a third connector 230. The connected, single unit (210, 220, 230) may be used in any location. For example, it can be used by someone going to the gym who wishes to drink a protein shake and water during the same workout. For example, it can be used by a child who goes to school and wishes to share/exchange drinks with other fellow children at the school. For example, it can be used by someone going to work who desires to have a certain drink before lunch and a certain drink in the afternoon or late evening. In other words, this bottle design allows individuals to transport/carry more than one favorite liquid drink and use both of them (or a plurality of them) during an activity or during the day, without requiring two separate bottles (or a plurality of separate bottles). Thus, consumers/users may exchange different drinks with friends and family and even strangers. The assembly, disassembly, and re-assembly of the bottle is easily performed with few and simple operations.

Furthermore, a Tetris-like, puzzle-like configuration can be assembled where a plurality of different chambers can be assembled together with a plurality of different connectors. The chambers can each be different geometric designs and can be combined together. In other words, the exemplary embodiments do not require symmetrical designs for assembly (as illustrated in FIG. 7). Any type of non-symmetrical geometrical designs may be put together with any type of connectors to form a single bottle. A single bottle can be formed by using more than two chambers and more than one connector. A single bottle can be formed by using any type of contemplated chambered designs and any type of contemplated connecting members.

Furthermore, expanding on the Tetris or puzzle concept, a huge puzzle may be assembled, where each piece of the puzzle is a different chamber containing a different liquid. For example, a 12-pack of drinks may be sold, where each of the drinks are different and each of the drinks is incorporated in a different chamber. The 12 chambers may be assembled together and sold as one unit or one package.

Moreover, several providers/manufacturers of drinks may wish to promote a new drink product with an existing drink product. Thus, a drink manufacturer may use such bottle configuration, for example, to promote a new flavor of soda/pop (e.g., vanilla, cherry, lemon, diet, etc.), and thus can sell both an existing version as well as the new version in one unit/one package, without requiring the consumer to purchase separate bottles for both flavors. In addition, a drink manufacturer may wish to promote a product (e.g., non-liquid product). Therefore, a first chamber may be filled with a drink and a second chamber may be provided with a product (e.g., a promotional MP3 player). Any type of promotional products may be incorporated with a drinking product. Of course, it is contemplated that both chambers (or a plurality of chambers) may not include any type of liquid products when attached/assembled together.

In addition further exemplary scenarios may be contemplated. For example, Gatorade® may wish to sell two different flavors in one bottle configuration or may wish to sell all their flavors in one single bottle configuration, where, for instance, 12 flavors are filled into 12 separate/distinct chambers, where the 12 chambers are connected to each other to form one bottle or one bottle configuration that can be shared. Coca Cola® also owns/sells/controls soda/pop as well as water, Vitamin water, tea, etc. It is contemplated that such a company may wish to sell one or more different and distinct drinks in one package (as a single bottle).

Figure 8A:
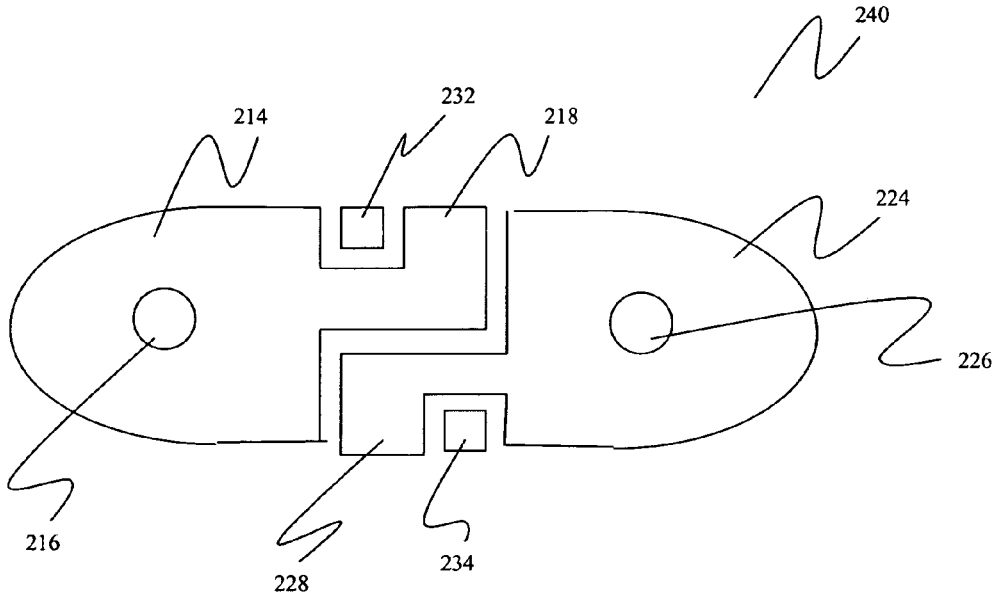
FIG. 8A is a top view of the dual-chambered drinking bottle of FIG. 7, where the two chambers and the connector are attached to each other, and where the connector is positioned on the outer perimeter of the two chambers, in accordance with the present disclosure.

With reference to FIG. 8A, there is presented a top view of the dual-chambered drinking bottle of FIG. 7, where the two chambers and the connector are attached to each other, and where the connector is positioned on the outer perimeter of the two chambers, in accordance with the present disclosure.

The top view 240 of the first bottle configuration 200 includes similar elements to those of FIG. 7. These elements include 214, 216, 218, 224, 226, 228, 232, and 234.

Figure 9:
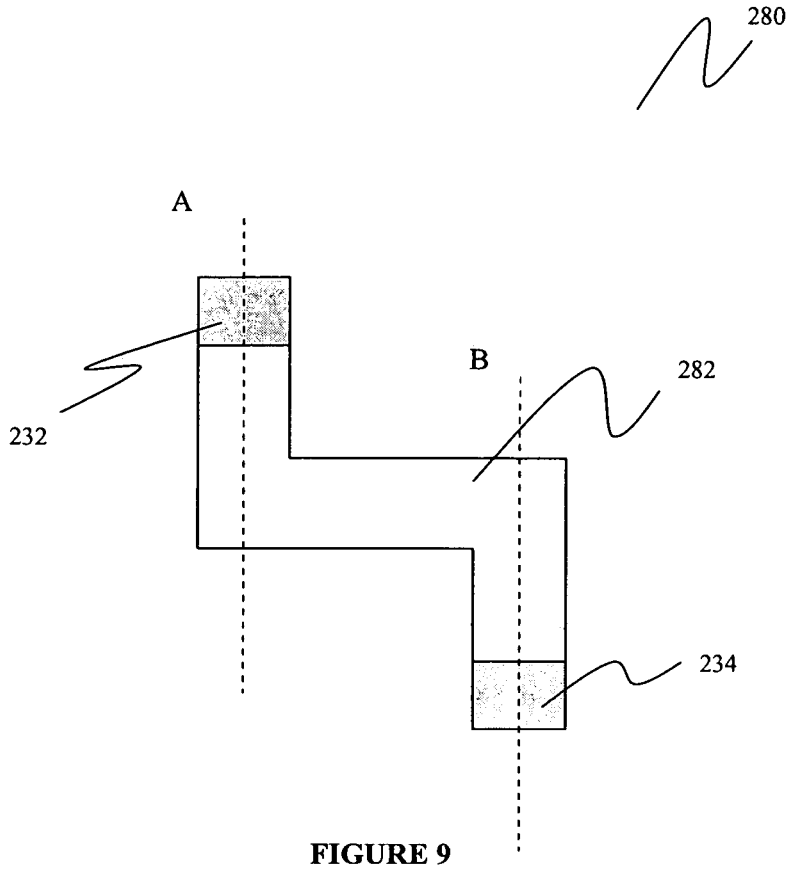
FIG. 9 is a top view of the U-shaped connector, where the U-shape extends longitudinally in two separate and parallel axes, in accordance with the present disclosure.

The top view 240 illustrates how the first chamber 210 and the second chamber 220 (see FIG. 7) are assembled via the third connector 230 in order to form a single bottle. As seen in FIG. 8A, the first top 232 and the second top 234 of the third connector 230 are illustrated in the middle portion of the drawing by the two dark rectangles on the top and bottom side of the drawing. The bottom portion of the third connector 230 is located on the bottom of the bottle configuration. FIG. 9 described below will further illustrate this point.

Figure 8B:
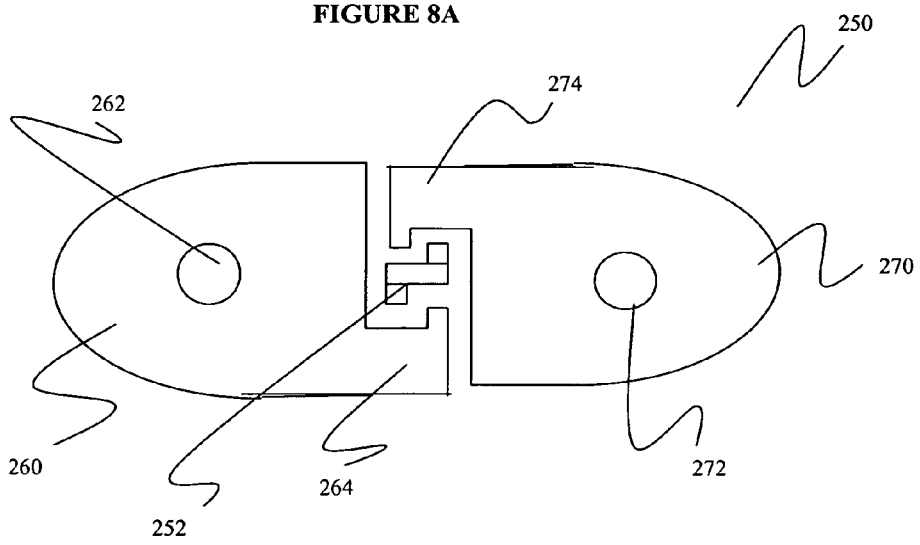
FIG. 8B is a top view of a dual-chambered drinking bottle, where the two chambers and the connector are attached to each other, and where the connector is positioned in a central location between the two chambers, in accordance with the present disclosure.

With reference to FIG. 8B, there is presented a top view of a dual-chambered drinking bottle, where the two chambers and the connector are attached to each other, and where the connector is positioned in a central location between the two chambers, in accordance with the present disclosure.

The top view of the second bottle configuration 250 includes a connector 252, a first top surface 260, a first orifice 262, a first connecting member 264, a second top surface 270, a second orifice 272, and a second connecting member 274.

The second bottle configuration 250 illustrates another exemplary assembly method. For example, the connector 252 may be centrally located in between the first connecting member 264 and the second connecting member 274 in order to connect two chambers. Of course, one skilled in the art can contemplate a plurality of different configurations where the connector 252 can be incorporated on any portion of the chambers.

With reference to FIG. 9, there is presented a top view of the U-shaped connector, where the U-shape extends longitudinally in two separate and parallel axes, in accordance with the present disclosure.

The top view 280 of the third connector 230 includes a bottom portion 282 of third connector 230. Additionally, the top view 280 includes similar elements to FIG. 7. These similar elements include 232 and 234.

FIG. 9 merely illustrates the "U-shape" used to connect the first chamber 210 and the second chamber 220 of FIG. 7. The middle portion is the bottom portion 282 of the U-shaped connector. Of course, the "U-shape" is not the only shape that can be used to engage first chamber 210 to second chamber 220. Any type of connector may be used for engaging the first chamber 210 to the second chamber 220. In addition, the "U-shape" connector need not be entirely located on a single axis. The "U-shape" connector may be located on two different axes, where the axes are parallel to each other. FIG. 9 illustrates two parallel axes, "A" and "B."

Figure 10:
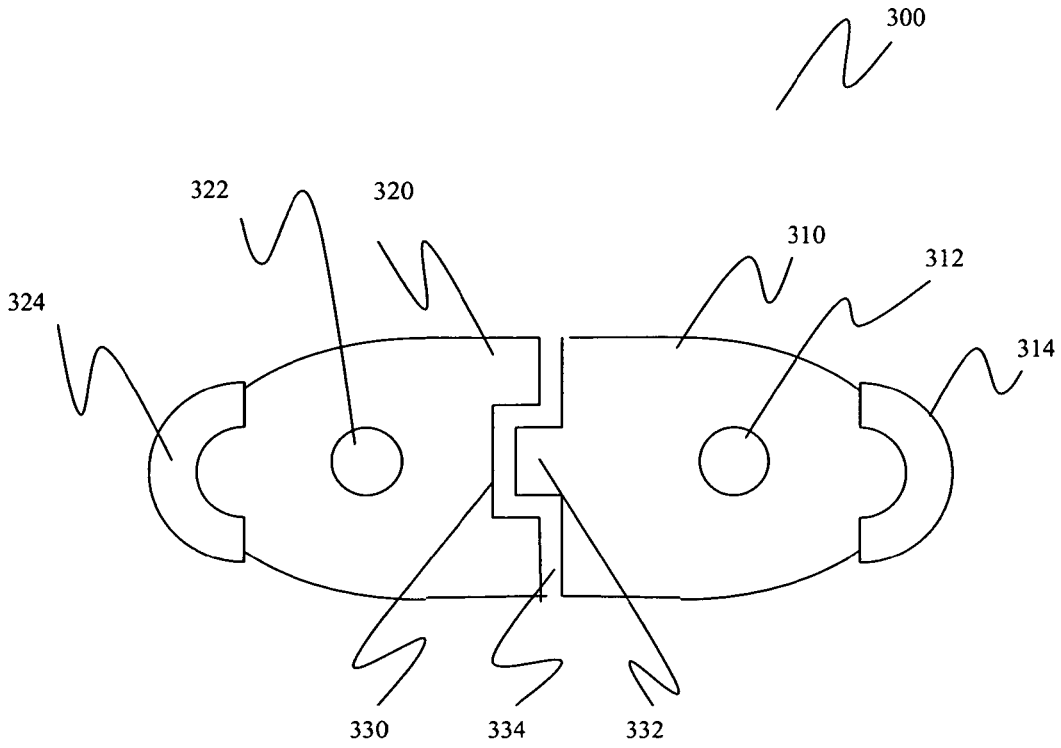
FIG. 10 is a top view of a dual-chambered drinking bottle, where the two chambers and the connector are attached to each other, and where the connector is positioned on the sides of the two chambers, in accordance with the present disclosure.

With reference to FIG. 10, there is presented a perspective view of a top view of a dual-chambered drinking bottle, where the two chambers and the connector are attached to each other, and where the connector is positioned on the sides of the two chambers, in accordance with the present disclosure.

The top view of the third bottle configuration 300 includes a top surface of first chamber 310, a first orifice 312, a first connecting member 314, a top surface of second chamber 320, a second orifice 322, a second connecting member 324, a female connector 330, a male connector 332, and a connection point 334.

The third bottle configuration 300 illustrates another exemplary assembly method. For example, the connector 252 may be located on a side of the first connecting member 314 and the second connecting member 324 in order to connect two chambers. Of course, one skilled in the art can contemplate a plurality of different configurations where the connector 252 can be incorporated on any portion of the chambers. Also, the first chamber connecting member 332 may be a male connector 332 and the second chamber connecting member 334 may be a female connector 330, where the male connector 332 and the female connector 330 securedly engage at the connection point 334. Of course, the connecting members may be any type of connecting members that may be connected to each other in a slidable, insertable, snapable or rotatable manner to engage the chambers to each other.

Figure 11:
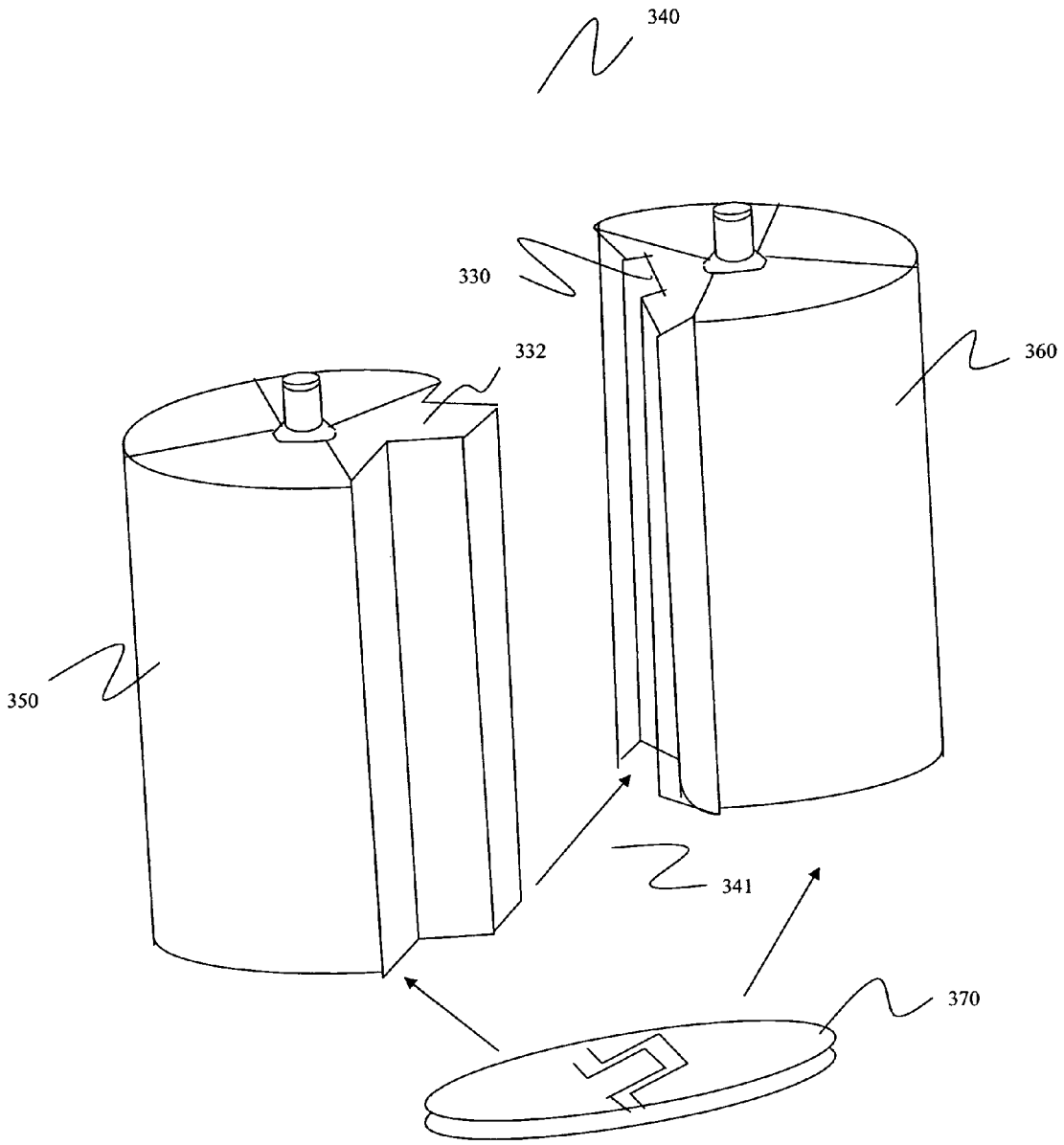
FIG. 11 is a perspective view of a dual-chambered drinking bottle, where a bottom connector connects the two chambers, in accordance with the present disclosure.

With reference to FIG. 11, there is presented a perspective view of a dual-chambered drinking bottle, where a bottom connector connects the two chambers, in accordance with the present disclosure.

The exploded view 340 of the third bottle configuration 300 includes a first chamber 350, a second chamber 360, a bottom portion connecting member 370, and an insertion direction 341. Additionally, the exploded view 340 includes similar elements to FIG. 10. These similar elements include 330 and 332.

FIG. 11 merely illustrates that a separate bottom portion connecting member 370 may be used to connect the first chamber 350 to the second chamber 360. The bottom portion connecting member 370 may be the only connector engaging the first chamber 350 to the second chamber 360. However, the bottom portion connecting member 370 may be used in conjunction with other connecting members described throughout this specification in all the exemplary embodiments. In other words, a plurality of connecting members may be used in conjunction with the bottom portion connecting member 370 to secure the first chamber 350 to the second chamber 360.

The insertion direction 341 merely illustrates how the first chamber 350 is engaged to the second chamber 360. For example, it may be a slidable connection. However, it could be an insertable connection, a rotatable connection, a threadable connection, a snapable connection or the like. Of course, it is contemplated that the first chamber 350 engages to the second chamber 360 without any external connectors. In other words, there is a direct connection between the first chamber 350 and the second chamber 360. This type of direct connection may be contemplated and/or envisioned for every exemplary embodiment described herein. Thus, the external connector may be optional.

Furthermore, there are certain challenges that have developed in the use of sport bottles or any type of bottles for that matter. For example, sport bottles are typically being utilized in an outdoor environment, which makes it very difficult to keep the contents cool. In most cases the sports bottle sits out in the sun or the hot air and rapidly loses the chilling effect of the liquid, with the result that an individual then have a warm liquid. This is highly undesirable as cool liquids are significantly more refreshing. In addition, with indoor health clubs/gyms being at room temperatures and warmer than preferred for a refreshing drink, many individuals may add ice to the drink to maintain it cooler. However, this can require time and effort in fitting the ice cubes individually into the bottle fill opening, and moreover dilutes all drinks other than water as the ice melts.

1131 Optionally, it is contemplated to use a single cooling element positioned at the base portion of the exemplary bottles of the present disclosure. The cooling element may be positioned in a separate compartment located at the bottom of both the first chamber and the second chamber in order to cool both liquids at the same time. It is noted that the cooling element may be a removable cooling element that can be replaced at any time by the user of the exemplary bottles. The cooling element may be any type of cooling element contemplated by one skilled in the art. Of course, a plurality of cooling elements may be utilized on the base portion, on the body portion and/or on the dividing wall of the exemplary bottles.

Moreover, while threaded connections may be utilized to connect various components in the described embodiments, many other forms of connections, such as snap together connections, twist-to-lock connections and the like also can be utilized. The present disclosure may also include a twist-on or snap-on spout or nozzle, preferably of a tapered conical or substantially cylindrical shape, and internally divided. The spout or nozzle may be adapted to be sealed by an end cap, a plug, by helically twisting the "overcap" upon a "scaling rod", or by sliding upon an internal shaft affecting a seal when screwed or pushed downwards towards the bottle.

Optionally, the body of all bottles of the present disclosure may be constructed of a clear or transparent or translucent material in order to better identify the liquid contained within the first chamber and the second chamber.

Additionally, all the bottles of the present disclosure are not limited to any particular bottle shape or design. Although the bottles are described and depicted herein as being of generally cylindrical upstanding form, the configurations of the containers is a matter of design choice. The use of generally cylindrical containers is described because it gives the sports bottle a readily acceptable appearance and shape, and because generally cylindrical container shapes tend to work well if one also desires to make use of generally cylindrical, externally threaded container necks. Moreover, generally cylindrical containers tend to efficiently provide good fluid-carrying capacity at relatively low manufacturing cost. While opaque, single-thickness materials may be preferred for use, transparent or plural-layer materials may be used, if desired, to enhance visibility, to provide added insulating capability, or for other purposes. For example, a puzzle-like configuration can be formed to comprise one or more bottles.

Moreover, the first chamber and the second chamber of all the bottles of the present disclosure may be designed to contain different ratios of liquids. For example, a 50/50 ratio between the first chamber and the second chamber may be preferred. However, it is envisioned that even a 1/3 to 2/3 ratio may be practical for certain applications or any other type of ratios.

Furthermore, all the bottles of the present disclosure may include one or more caps or lids, and each of the one or more caps or lids may have a strap connected to the body. All the bottles of the present disclosure may include one or more cooling elements to cool the liquids contained within the chambers or containers. All the bottles of the present disclosure may include one or more collapsible portions to bend the chamber or containers. All the bottles of the present disclosure may be of different widths and/or heights, and each chamber of all the bottles may be of a different width and/or height. All the bottles of the present disclosure may have different caps of different shapes and/or sizes with a plurality of fastening means. All the bottles of the present disclosure may include slidable/rotatable orifices moving on a slidable track in a variety of tracks. All the bottles of the present disclosure may have interchangeable/removable/detachable parts.

Finally, all the bottles of the present disclosure may be constructed by any manufacturing means. For example, blow molding technology/injection molding/rapid tool prototyping may be utilized. A plurality of different types of thermoplastic resins may be utilized in any type of blow molding/injection molding techniques.

Accordingly, the present disclosure prevents the mixing of contents of multiple chambers during the storing and dispensing process, thus minimizing or even eliminating the risk that a plurality of liquids are simultaneously dispensed in an inadvertent manner.

Accordingly, the present disclosure permits the assembly of a plurality of chambers, each having separate content, where the plurality of chambers are connected to each other directly or indirectly via external connectors. A plurality of external connectors may be used to connect the plurality of chambers to form a single bottle or several bottles. However, a plurality of chambers may be connected to each other directly (e.g., without any external connectors).

It will be understood that there are to be no limitations as to the dimensions and shape of the beverage bottle, including the storage compartment, or the materials from which the beverage bottle is manufactured. The bottles may be constructed to resemble any commercially available bottle for holding a liquid beverage and may be manufactured from any suitable plastic, glass or metal material. Furthermore, it should be understood that the beverage bottle of the present disclosure may be adapted to store any suitable liquid, such as, for example, water, juice, milk, carbonated sodas, protein shakes, energy drinks, beer, wine, and liquor. A beer or liquor manufacturer/seller may wish to incorporate several different alcoholic drinks in one package as one unit. The exemplary bottles of the present disclosure may be utilized in a variety of industries with drinkable liquids or non-drinkable liquids (e.g., household products, transmission oil, etc.)

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

Having described the invention above, various modifications of the techniques, procedures, material and equipment will be apparent to those in the art. It is intended that all such variations within the scope and spirit of the appended claims be embraced thereby.

The foregoing examples illustrate various aspects of the invention and practice of the methods of the invention. The examples are not intended to provide-an exhaustive description of the many different embodiments of the invention. Thus, although the foregoing invention has been described in some detail by way of illustration and example for purposes of clarity and understanding, those of ordinary skill in the art will realize readily that many changes and modifications can be made thereto without departing form the spirit or scope of the invention.

What is claimed is:

1. A bottle, comprising:

a body portion having a dividing wall extending from a base portion to a connection region, the connection region including a first connector and a second connector, the first connector being a U-shaped connector that cooperates with the second connector such that a portion of the second connector is contained within the first connector, such that the U-shaped connector is prevented from contacting the dividing wall, and such that the second connector is positioned entirely within an upper portion of the bottle;

a first chamber for holding first content, the first chamber configured to cooperate with a first orifice via a first access surface; and a second chamber for holding second content, the second chamber configured to cooperate with a second orifice via a second access surface;

wherein the first and second access surfaces are independently detachable/attachable relative to each other during use of the bottle.

2. The bottle according to claim 1, wherein one end of the first surface and one end of the second surface are secured to the first connector.

3. The bottle according to claim 2, wherein the first surface and the second surface are oblique surfaces with respect to the base portion of the bottle.

4. The bottle according to claim 1, wherein the dividing wall is devoid of any perforations to prevent the first content of the first chamber to intermix with the second content of the second chamber.

5. The bottle according to claim 1, wherein the dividing wall is a detachable dividing wall.

6. The bottle according to claim 1, wherein the first orifice extends away from the first surface; and wherein the second orifice extends away from the second surface, such that the first and second surfaces selectively receive a mouth of a user.

7. The bottle according to claim 1, wherein the first orifice is a single opening for accessing the first content; and wherein the second orifice is a sin& opening for accessing the second content.

8. The bottle according to claim 1, wherein the second connector separates the first connector from the dividing wall.

9. The bottle according to claim 1, wherein side walls of the second connector contact side walls of the first connector across an entire length thereof, the length defined to be perpendicular to the dividing wall.

10. The bottle according to claim 1, wherein the first and second surfaces are detachable from the bottle during use, the first and second surfaces being separate and distinct from each other and in an opposed relationship thereof.

11. The bottle according to claim 1, wherein the first and second surfaces are interchangeable surfaces during use, the first and second surfaces being separate and distinct from each other and in an opposed relationship thereof.

12. The bottle according to claim 11, wherein the interchangeable surfaces permit different types of orifices to attach to the bottle during use.

13. The bottle according to claim 1, further including a handle connected to the first connector.

14. A bottle, comprising:

a first chamber for holding a first liquid;

a second chamber for holding second liquid;

a body portion having a dividing wall extending from a base portion to a connection region, the connection region including a first connector and a second connector, the first connector being a U-shaped connector that cooperates with the second connector such that a portion of the second connector is contained within the first connector, such that the U-shaped connector is prevented from contacting the dividing wall, and such that the second connector is positioned entirely within and upper portion of the bottle; and a handle connected to the first connector.

15. The bottle according to claim 14, wherein the dividing wall is devoid of any perforations to prevent the first liquid of the first chamber to intermix with the second liquid of the second chamber.

16. A method for manufacturing a bottle, the method comprising the steps of:

forming a body portion having a dividing wall extending from a base portion to a connection region, the connection region including a first connector and a second connector, the first connector being a U-shaped connector that cooperates with the second connector such that a portion of the second connector is contained within the first connector, such that the U-shaped connector is prevented from contacting the dividing wall, and such that the second connector is positioned entirely within an upper portion of the bottle;

forming a first chamber for holding first content, the first chamber configured to cooperate with a first orifice via a first access surface; and forming a second chamber for holding second content, the second chamber configured to cooperate with a second orifice via a second access surface;

wherein the first and second access surfaces are separate and distinct components, on opposed ends thereof, such that the first surface is independently detachable/attachable relative to the second surface and vice versa, during use of the bottle.

* * * * *